United States Patent [19]

Grin

[11] Patent Number: 4,463,829

[45] Date of Patent: Aug. 7, 1984

[54] FOLDABLE LADDER

[76] Inventor: Ariy Grin, 611 Argyle Rd., Brooklyn, N.Y. 11230

[21] Appl. No.: 352,318

[22] Filed: Feb. 25, 1982

[51] Int. Cl.[3] ..... E06C 1/383

[52] U.S. Cl. ..... 182/160; 182/96; 182/108

[58] Field of Search ..... 182/159–162, 182/107, 108, 94–96

[56] References Cited

U.S. PATENT DOCUMENTS

| | | | |
|---|---|---|---|
| 1,600,103 | 9/1926 | Evans | 182/108 |
| 2,925,877 | 2/1960 | Wright | 182/108 |
| 3,025,923 | 3/1962 | Burnstein | 182/96 |
| 3,292,735 | 12/1966 | Utley | 182/176 |
| 3,414,081 | 12/1968 | Wedvik | 182/96 |
| 4,030,565 | 6/1977 | Chaput | 182/151 |
| 4,182,431 | 1/1980 | Wing | 182/167 |

FOREIGN PATENT DOCUMENTS

| | | | |
|---|---|---|---|
| 208712 | 4/1960 | Austria | 182/159 |
| 620101 | 5/1961 | Italy | 182/160 |

*Primary Examiner*—Reinaldo P. Machado
*Attorney, Agent, or Firm*—Natter & Natter

[57] ABSTRACT

A self-storing foldable ladder having a pair of side rails and a plurality of step rungs, each rung being pivotally mounted to one of said rails. The other of said rails includes a guide pin for cooperatively engaging a longitudinal groove within the rung. The rungs are adapted for swingable displacement about the pivot as the side rails are moved into abutting contact. The rails are then linearly translatable with the guide pin being slidable within the groove and the rails assuming a mutually coextensive position with the rungs housed therebetween. A releasable locking mechanism is adapted for securing the rails when in this folded mode; alternatively, the locking mechanism stabilizes the ladder when in an open mode.

13 Claims, 10 Drawing Figures

FIG. 1
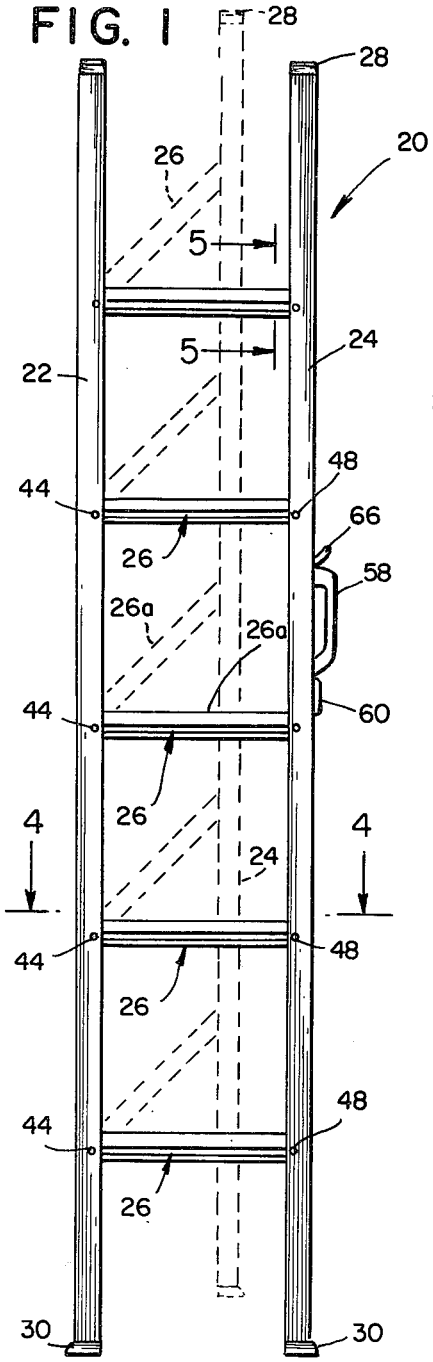
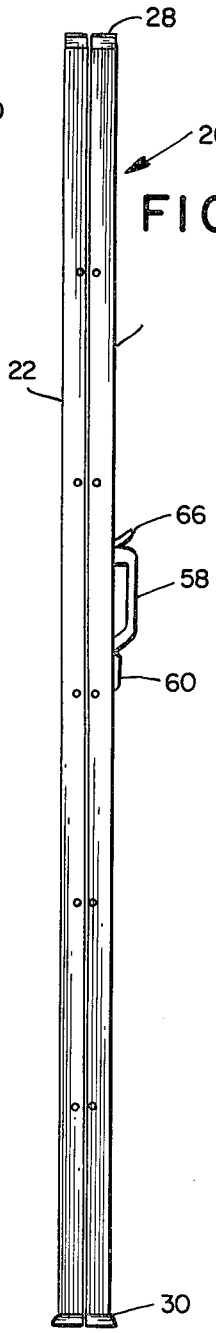
FIG. 2
FIG. 3
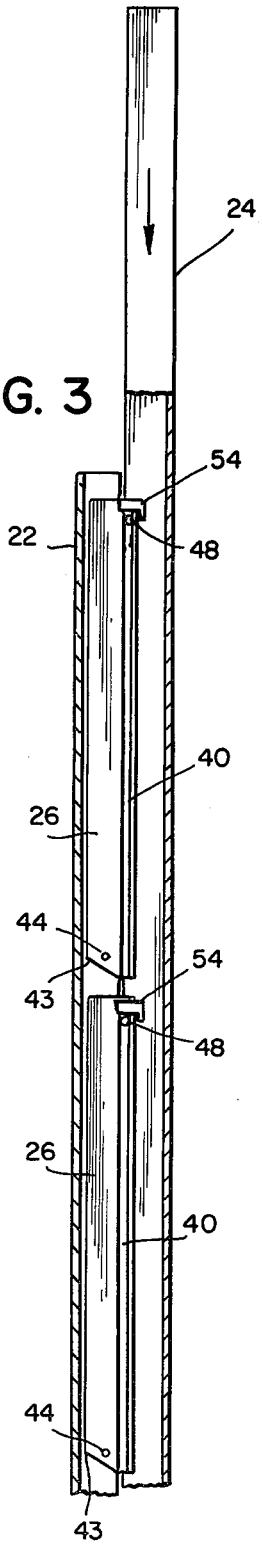
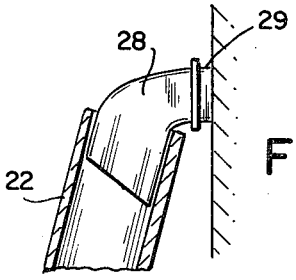
FIG. 9
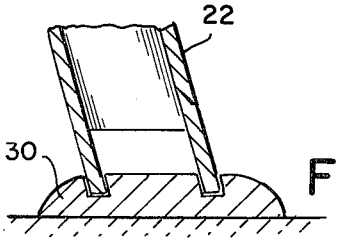
FIG. 10

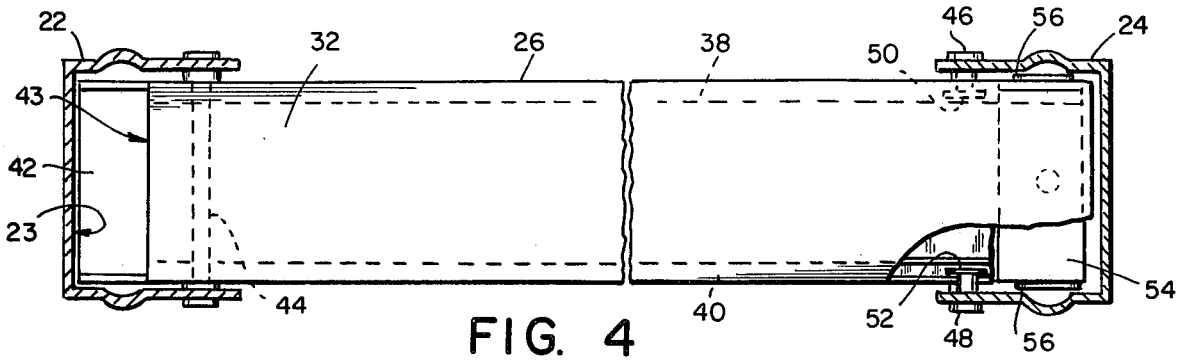
FIG. 4
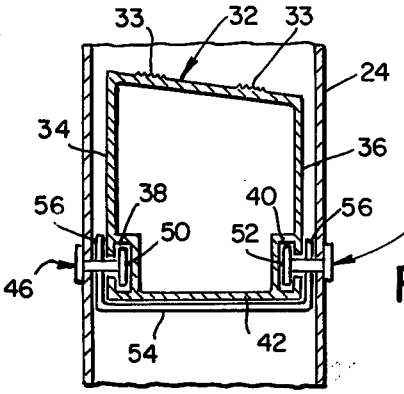
FIG. 5
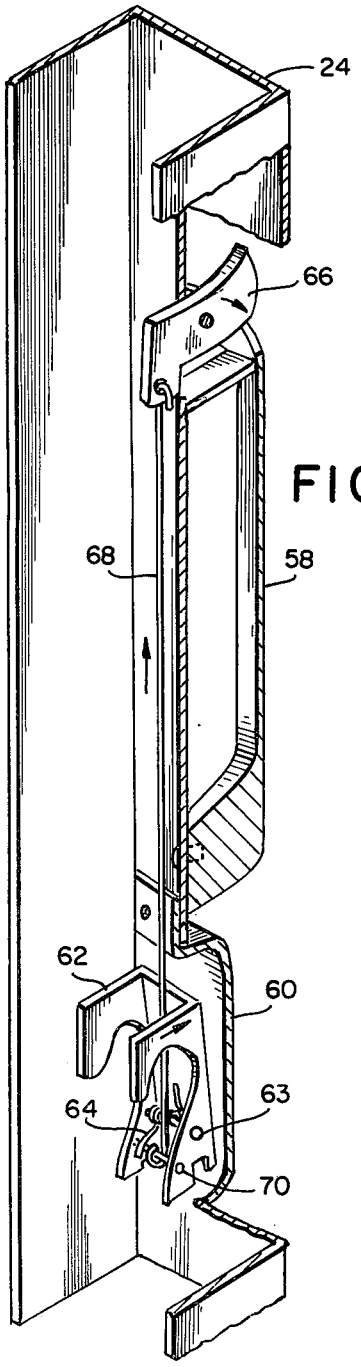
FIG. 6
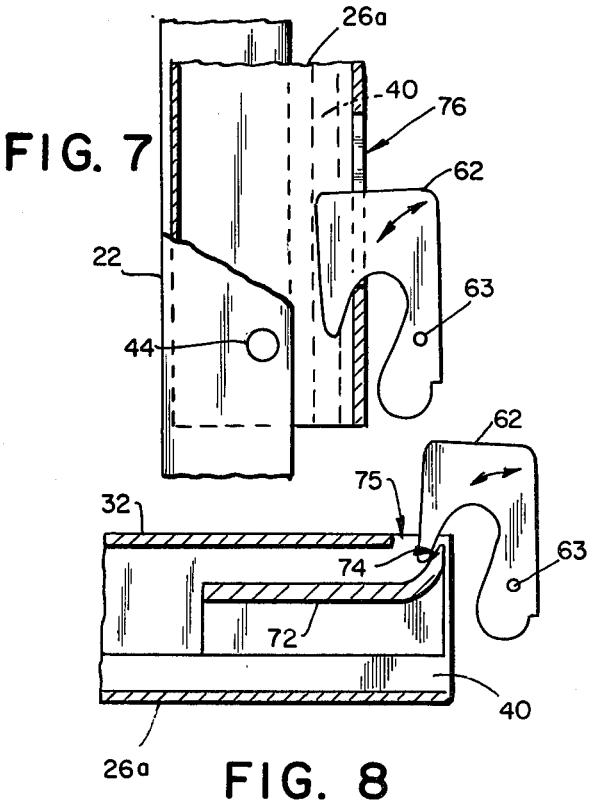
FIG. 7
FIG. 8

FOLDABLE LADDER

TECHNICAL FIELD

This invention relates to step ladders and especially to a foldable ladder having a modified parallelogram linkage.

In particular, the device of this invention concerns a self-storing ladder having parallel movable stiles and pivotable rungs.

BACKGROUND ART

The collapsible ladder devices of the prior art were frequently encountered in wall mounted apparatus for use as a fire or emergency escape as typically illustrated in U.S. Pat. Nos. 350,047 and 3,756,347. A distinct limitation of those devices was that they were not designed for compact storage and more importantly, could not be readily transported for use elsewhere.

With regard to free standing collapsible ladders, the structures previously disclosed in the art generally included an arrangement of parallel rails with pivotally connected rungs such as described in U.S. Pat. Nos. 3,439,776, 3,722,622 and 2,875,935.

A distinct shortcoming of the foregoing ladders was that they did not provide self-storable capabilities. Although these previous devices incorporated rails that moved in parallelism, when the rails were in mutual contact with the ladder collapsed, one rail extended beyond the other, thus forming a longer mass. In addition, those devices of the prior art did not include an integrated latch arrangement for stabilizing the rungs in the unfolded mode or for securing the side rails when in the folded state.

The device of the present invention solves many of the problems of the prior art by providing an articulated ladder structure having the ability for compound pivotal and sliding movement. Although this general displacement application may have been shown in U.S. Pat. No. 2,972,153, the device of the instant invention, as will be apparent hereinafter, includes many components and structural features which improve upon and provide the degree of strength, durability and rigidity required for a load bearing ladder.

DISCLOSURE OF THE INVENTION

Briefly, the nature of this device involves a stowable, lightweight, portable ladder adapted for general purpose usage. The foldable ladder of this invention includes a plurality of step rungs spanning between a set of parallel rails. The ladder components are articulated for sequential compound movement between an operational and stowage mode. The step rungs are adapted for angular parallelogram displacement as the rail members are moved into the folded position. the rail members are then linearly translatable for registration with the rungs being housed between the confronting rail members.

A locking mechanism includes a spring loaded latch member for selective engagement with a receiver element incorporated in a step rung to provide stability to the ladder when in the open position. A latch receiving recess within the step rung is intended for accommodating the latch member when folded to retain the complementary rails.

The locking mechanism is formed within one of the rail members and further includes an integral carry handle and proximate thumb lever for operating the latch member.

The gist of the present invention concerns the interrelationship of the component elements wherein the rail members are mutually coextensive and the rungs are stored between the abutting rails. This provides a self-storing carry case for the ladder and obviates a problem existent in the prior art wherein the folded ladder had one rail projecting above the other rail and thus presented a longer mass when folded.

A further feature of the present invention is directed to the integral locking mechanism which is functional both to stabilize the unfolded ladder and to secure the rail members when the ladder is collapsed. This locking arrangement eliminates a disadvantage previously encountered wherein a removable rung, lug or brace was required to positively secure the ladder in an open, use position.

Another advantage of the foldable ladder of this invention concerns the incorporation of a pedestal member or shoe for providing a secure footing and also the inclusion of a buttress or nose element for engaging a vertical support surface.

In view of the foregoing, it should be apparent that the present invention overcomes many of the shortcomings of the prior art devices and provides a foldable ladder which overcomes many of the problems of the prior art.

Having thus described the invention, it will be seen that it is an object thereof to provide a foldable ladder of the general character described herein which is not subject to the aforementioned disadvantages.

Specifically, it is an object of this invention to provide a foldable ladder wherein the rail members form a carrying case for storing the rungs when the ladder is folded.

Another object of this invention is to provide a foldable ladder that encompasses a locking mechanism which cooperatively interacts with a rung member for selectively stabilizing the ladder in an open position and alternately securing the folded ladder in a closed position.

Yet another object of this invention is to provide a foldable ladder which is comparatively simple in construction, low in cost, reliable in use and well adapted for mass production fabrication techniques.

Other objects, features and advantages of the invention will in part be obvious and will in part be pointed out hereinafter.

With these ends in view, the invention finds embodiment in certain combinations of elements and arrangements of parts by which the objects aforementioned and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown a possible exemplary embodiment of the invention, FIG. 1 is a front elevational view of a folding ladder constructed in accordance with the present invention in a fully open position and showing a set of parallel rail members and a plurality of step rungs; displacement of the ladder into a partially closed position is indicated in broken lines;

FIG. 2 is a front elevational view of the ladder of this invention illustrating the fully closed condition wherein the rail members form an enclosure for conveniently transporting the ladder;

FIG. 3 is a fragmentary enlarged elevational view with parts broken away and partly in section illustrating the rung stowage within the rail members and further indicating the direction of movement of the rail member for registration of the companion rails;

FIG. 4 is an enlarged sectional view taken substantially along line 4—4 of FIG. 1 with portions broken away and partly in section and showing the rung member pivotally secured in one rail member and slidably attached to the other of said rail members;

FIG. 5 is a partial sectional view taken substantially along line 5—5 of FIG. 1 showing the slidable engagement of the rung to the other of said rail members including a pair of guide pins slidably receivable within longitudinal grooves;

FIG. 6 is an enlarged perspective view with portions broken away for illustrating a locking mechanism incorporated in the rail member and showing an internally mounted spring loaded latch operatively linked to an externally projecting thumb lever pivotally mounted to a carry handle;

FIG. 7 is a fragmentary enlarged sectional view of the middle rung when the ladder is in the closed position showing an opening in a bottom wall adapted for cooperatively receiving the latch when the companion rail members are in confronting relationship;

FIG. 8 is a partial sectional view to an enlarged scale of the middle rung showing an arcuate catch plate for receiving the latch when the ladder is in the fully open position FIG. 9 is a partial side elevational view showing an upper portion of the rail member including an interfitting angular buttress and a rubberized bumper positioned against a vertical support surface; and FIG. 10 is a partial side elevational view of a lower end of the rail member showing a slip resistant pedestal for providing horizontal stability.

BEST MODE FOR CARRYING OUT THE INVENTION

Referring now in detail to the drawings, the reference numeral 20 denotes generally a foldable ladder constructed in accordance with this invention.

The ladder 20 as typically illustrated in FIG. 1 is shown in an open or unfolded mode. Although the ladder is preferably constructed of aluminum or an alloy thereof, other suitable lightweight metals, steel, wood or similar materials can be used for achieving equivalent structural rigidity, strength and durability. It should further be noted that the length and width dimensions of the ladder can also be modified in accordance with specific requirements.

With regard to the embodiment illustrated, the ladder 20 includes a pair of parallel stiles or side rail members 22, 24 which support a plurality of transverse step rungs 26. The rail members 22, 24 have a substantially channel shaped cross section, however, they can be fabricated from any structural member having an equivalent web and flange portion for enclosing the rungs 26 as will be further described hereinafter.

In order to provide improved contact with the ladder support surfaces, the uppermost end of the rail members 22, 24 has an interfitting angular buttress 28 as shown in FIG. 9 having a rubberized bumper 29 to provide a positive slip-free grip when the ladder is placed against a wall or other substantially vertical support surface. The lower-most end of the rail members 22, 24 is similarly fitted with a slip resistant pedestal or shoe 30 as shown in FIG. 10 for providing horizontal stability when the ladder is in use.

The step rung 26 shown in FIGS. 4 and 5 has a substantially rectangular cross section for providing structural rigidity to the ladder 20 and for preventing twisting under load; in addition, this preferred cross section maximizes the load supporting capacity. It should also be observed that an upper surface 32 of the rung 26 is inclined with respect to a horizontal plane. The angle of inclination is related to the angular orientation of the ladder when supported against a vertical surface, such that the upper surface 32 will be substantially horizontal when the ladder is in use.

In addition, the upper rung surface 32 includes an integral ribbed portion 33 forming a tread for improved foot traction.

A pair of opposed parallel side walls 34, 36 define a groove 38, 40 spanning the length of the rung 26. In addition, a continuous bottom wall 42 extends normally to the side walls 34, 36.

The rung 26 is pivotally secured at one end to the rail 22 and is journalled about a shaft or pin 44 provided at equally spaced locations along the rail 22. In order to provide clearance for swingable rung movement, the upper surface 32 is foreshortened and terminates at 43 with the side walls 34, 36 being beveled for convergence slightly above the groove 38, 40. In this manner the bottom wall 42 and lower portion of the side walls 34, 36 abut against a web portion 23 of rail 22 when the rung 26 is substantially horizontal.

The distal end of the rung 26 is supported by a pair of double head studs 46, 48. An innermost head 50, 52 of each stud is slidably engageable within the respective longitudinal groove 38, 40.

In order to prevent the studs 46, 48 from becoming disengaged from their respective grooves 38, 40 during rotational movement of the rung 26, a guard bracket 54 is screw fastened to the bottom wall 42 at the marginal end of the rung 26. The guard bracket 54 includes two upstanding arms 56 which are effective for blocking the heads 50, 52 from exitting through the open end of the groove 38, 40.

The locking mechanism will now be described with particular reference to FIG. 6. The rail 24 is provided with an integral carrying handle 58 and latch housing 60. A spring loaded hooking latch element 62 is pivotally mounted about a pin 63 within the latch housing 60 and includes a coil spring 64 for urging the latch 62 in a counterclockwise direction. The latch 62 is swingably displaceable in a clockwise direction (as indicated by the arrow) and into the latch housing 60 through the use of an operating lever 66. The lever 66 is rotatably mounted to the rail 24 adjacent to the handle 58 and includes a connecting rod 68 which engages an operating pin 70 on the latch 62. It should be observed that when a downward force is applied to the lever 66 (in the direction of the arrow), the connecting rod 68 will be displaced upwardly and the latch 62 will disengage and pivot into the latch housing 60.

When the ladder 20 is in the fully opened and operative position as shown in FIG. 1, the latch 62 engages a catch plate 72 formed in a middle step rung 26*a* adjacent the latching mechanism as shown in FIG. 8. The catch plate 72 is formed with an arcuate receiving lip 74 mounted within the step rung 26*a*. An opening 75 is formed in the upper rung surface 32 for permitting entry of the latch 62 and engagement with lip 74.

When the ladder is in the folded position as shown in FIG. 2, the step rung 26*a* is in a substantially vertical orientation. The latch 62 is then engageable in a latch receiving aperture or recess 76 formed in the bottom wall 42 as shown in FIG. 7.

In operation, in order to fold the ladder 20 the rail 24 is lifted and moved toward rail 22; the step rungs 26 then pivot about pin 44 in the manner shown in FIG. 1. When the rails 22, 24 are in confronting relationship, the rail 24 will extend above the rail 22. In this position, the rungs 26 are substantially vertical and the rail 24 is linearly displaceable in a downward direction with the studs 46, 48 slidable in respective grooves 38, 40 until rail 24 is in registration with the rail 22 and the latch 62 is seated within recess 76. This closed position is shown in FIG. 2; it should also be apparent that the rails 22, 24 now enclose the rungs 26 and present a self-contained carry case. The ladder 20 can be opened following a reverse procedure after releasing the latch 62. When the ladder 20 is fully open, the latch 62 is now inserted into opening 75. It should be further noted that release of the latch 62 is conveniently controlled by the thumb operated lever 66.

Thus, it will be seen that there is provided a foldable ladder assembly which achieves the various objects of the invention and which is well adapted to meet the conditions of practical use.

Since various possible embodiments might be made of the present invention and various changes might be made in the exemplary embodiments set forth, it is to be understood that all material set forth or shown in the accompanying drawings is to be interpreted as illustrative and not in a limiting sense.

I claim:

1. A self-storing foldable ladder comprising a pair of companion side rails, a plurality of transverse rung members mounted at spaced intervals between said rails, said rung members including an upper wall defining a tread surface, a bottom wall and two opposed side walls, said side walls having a longitudinal groove substantially coextensive with the rung, pivot means in one of said side rails, said pivot means including a pin extending from said rail with one end of each of said rung members being journalled about a respective pin, guide means in the other of said side rails, said guide means including a stud mounted to said rail, with a head of said stud being slidably received in each of said longitudinal grooves, said rungs being swingably displaceable about said pivot means as the side rails are moved into abutting contact, locking means mounted in one of said side rails, said locking means including a hooking latch member, said latch member being adapted for interfitting engagement with one of said rung members by insertion through an opening in the upper wall to stabilize the ladder when in an operational mode, further including a recess within the bottom wall of said rung, said recess being adapted for interfitting engagement by the latch member when the side rails are in abutting contact to secure the side rails in a storage mode whereby the ladder may be carried in a substantially horizontal position.

2. A self-storing foldable ladder as claimed in claim 1 further including guard means affixed to the rung member at a margin thereof for preventing removal of the stud from an open end of the longitudinal groove.

3. A self-storing foldable ladder as claimed in claim 1 wherein the ends of the side walls at the pivot means are bevelled toward the upper wall for providing clearance to permit swingable rung movement.

4. A self-storing foldable ladder as claimed in claim 1 wherein the hooking latch member is pivotally mounted and resiliently urged for interfitting engagement with said rung member.

5. A self-storing foldable ladder as claimed in claim 4 wherein the locking means further includes connecting rod means for disengaging the hooking latch member.

6. A self-storing foldable ladder as claimed in claim 5 wherein the connecting rod means are linked to a rotatable operating lever mounted to said side rail.

7. A self-storing foldable ladder as claimed in claim 4 further including a latch housing formed within the side rail, said latch housing being adapted for containing the hooking latch member.

8. A self-storing foldable ladder as claimed in claim 1 further including a catch plate, said catch plate being mounted in confronting relationship with said opening in the upper wall of said rung member and adapted for engaging said hooking latch member.

9. A self-storing foldable ladder as claimed in claim 1 wherein the bottom wall and at least a portion of the side walls abut against the side rail when the rung members are in a substantially horizontal and operational position.

10. A self-storing foldable ladder as claimed in claim 1 further including handle means affixed to one of said side rails for carrying the ladder in a horizontal position when in the storage mode.

11. A self-storing foldable ladder as claimed in claim 1 wherein the rung member includes an inclined tread surface, said inclination compensating for the angular orientation of the ladder when in use and for presenting a substantially horizontal tread surface.

12. A self-storing foldable ladder as claimed in claim 11 wherein the lower end of said side rail is fitted with a slip resistant shoe means for providing added stability when the ladder is in use.

13. A self-storing foldable ladder as claimed in claim 12 wherein the upper most end of said rail includes a buttress element, said buttress element being angularly oriented for substantially flat contact with a vertical support surface when the ladder is in use.

* * * * *